United States Patent [19]

Akita

[11] 4,164,098

[45] Aug. 14, 1979

[54] GRINDING WHEEL

[76] Inventor: Hiroshi Akita, 549 Banchi, Oaza Nishi, Kamioka-cho, Yoshiki-gun, Gifu Prefecture, Japan

[21] Appl. No.: 832,913

[22] Filed: Sep. 13, 1977

[30] Foreign Application Priority Data

Sep. 13, 1976 [JP] Japan ..... 51-123883

[51] Int. Cl.[2] ..... B24D 7/04

[52] U.S. Cl. ..... 51/209 R

[58] Field of Search ..... 51/206 NF, 209 R

[56] References Cited

U.S. PATENT DOCUMENTS

| | | | |
|---|---|---|---|
| 3,123,948 | 3/1964 | Kistler | 51/206 NF |
| 3,256,644 | 6/1966 | Kistler | 51/206 NF |
| 3,400,497 | 9/1968 | Shoemaker | 51/209 R |
| 3,477,180 | 11/1969 | Robertson | 51/206 NF X |
| 3,746,266 | 7/1973 | Knox | 51/206 NF X |
| 3,867,795 | 2/1975 | Howard | 51/206 NF X |

*Primary Examiner*—Gary L. Smith

*Attorney, Agent, or Firm*—Auslander & Thomas

[57] ABSTRACT

A grinding wheel in which at least one core material of open-mesh fabric woven of glass fiber yarn and at least one core material of floral design made by forming glass fiber yarn in floral pattern of long and short petals are embedded as reinforcing core materials.

5 Claims, 7 Drawing Figures

GRINDING WHEEL

This invention relates to a grinding wheel in which at least one core material of open-mesh fabric woven of glass fiber yarn and at least one core material of floral design made by forming glass fiber yarn in floral pattern of long and short petals, are embedded.

The conventional grinding wheel of offset type (recessed center) uses open-mesh glass cloth as a reinforcing core material. Especially for high speed grinding wheels which are operated at a high speed of 10,000 r.p.m. or higher, the core material for them is made by soaking open-mesh (9–18 strands per 25.4mm) glass cloth in a coating agent (synthetic resin, such as phenolic resin, formaldehyde resin, polyester resin, polyamide resin, epoxy resin, melamine resin, butyl resin, denatured phenol resin, etc., dissolved in water or in an organic solvent), drying it and then cutting it by a punch into a round shape corresponding to the diameter of the grinding wheel.

In studying the strength of prior art the grinding wheel a in which a core material b of open-mesh glass cloth is embedded, as shown in FIG. 7 centrifugal forces fc, fc, fc are uniform in circumferential direction relative to the center c. However, those parts of the grinding wheel where an extension line of yarn d passes the center c are high in strength but the remaining sectoral parts are low in strength. Therefore, strength in relation to the centrifugal force is not uniform in circumferential direction. Moreover, the core material b has such defect that it is easy to be cracked (crack e), while in use, in polygonal shape having a diameter about 60–70% of the diameter of the grinding wheel as represented by a chain line in FIG. 7.

In order to eliminate the above-mentioned defect, a grinding wheel in which a plurality of core materials b which are put one upon another in such a fashion that yarns d of the core material cross each other at the angle of 45° are embedded, has been devised. This construction, however, has the disadvantage that grinding grains of an upper layer and a bottom layer of the core materials are not jointed well because a plurality of core materials are inserted and accordingly the grinding side and the non-grinding side of the grinding wheel are easy to disjoin with the core material b as a boundary while the grinding wheel is in use.

In view of the above disadvantage, the present invention has for an object to provide a grinding wheel in which a core material having a floral design formed with glass fiber yarn is embedded as a reinforcing material, together with the conventional core material of woven fabric, so as to improve resistance to centrifugal force and resistance to breakage.

The present invention consists of:

(1) A grinding wheel characterized in that at least one core material of open-mesh glass cloth and at least one core material of floral design with assembly of long and short petals are embedded therein.

(2) The grinding wheel as mentioned in item (1) above, in which one each of core material of woven fabric and core material of floral design are embedded in an intermediate part thereof.

(3) The grinding wheel as mentioned in item (1) above, in which a core material of woven fabric is embedded in the surface layer opposite the grinding side.

(4) The grinding wheel as mentioned in item (1) above, in which a core material of floral design is embedded in the surface layer of grinding side.

(5) The grinding wheel as mentioned in item (1) above, in which a core material of woven fabric is embedded in the surface layer opposite the grinding side and a core material of floral design is embedded in the surface layer of grinding side.

(6) The grinding wheel as mentioned in item (4) or (5) above, in which the diameter of long petals of the core material of floral design is about 80% of or less than 80% of that of the grinding wheel.

The nature and other advantages of the present invention will be understood more clearly and specifically from the following description made with reference to an embodiment and the accompanying drawings in which.

Figure 1:
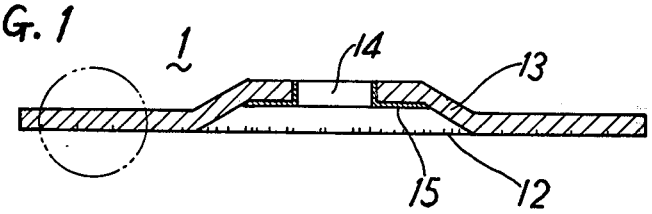
FIG. 1 is a longitudinal section, at the center, of the grinding wheel according to the present invention.
Figure 2:
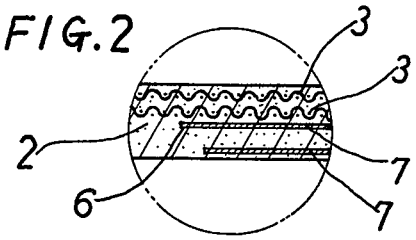
FIG. 2 is a sectional view on an enlarged scale of the part encircled by a chain line in FIG. 1.
Figure 3:
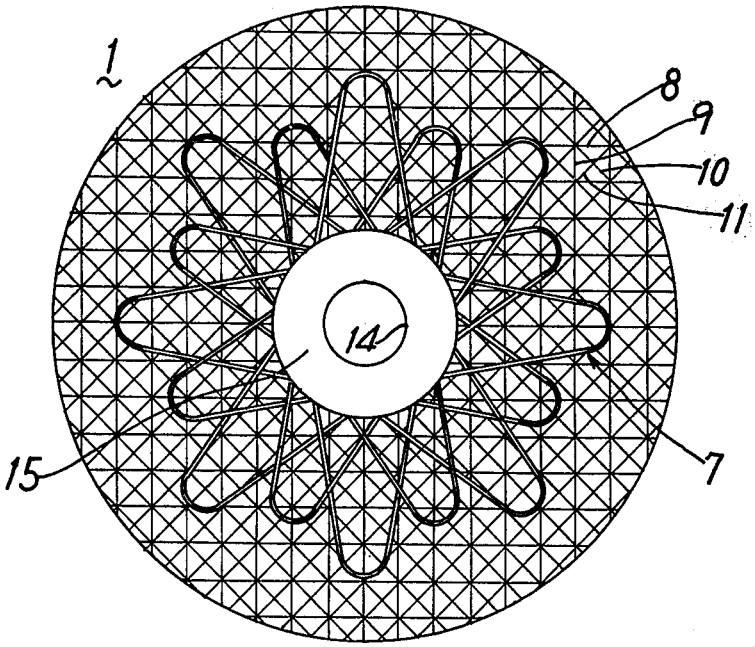
FIG. 3 is a front view of the grinding side of the grinding wheel of the present invention.
Figure 4:
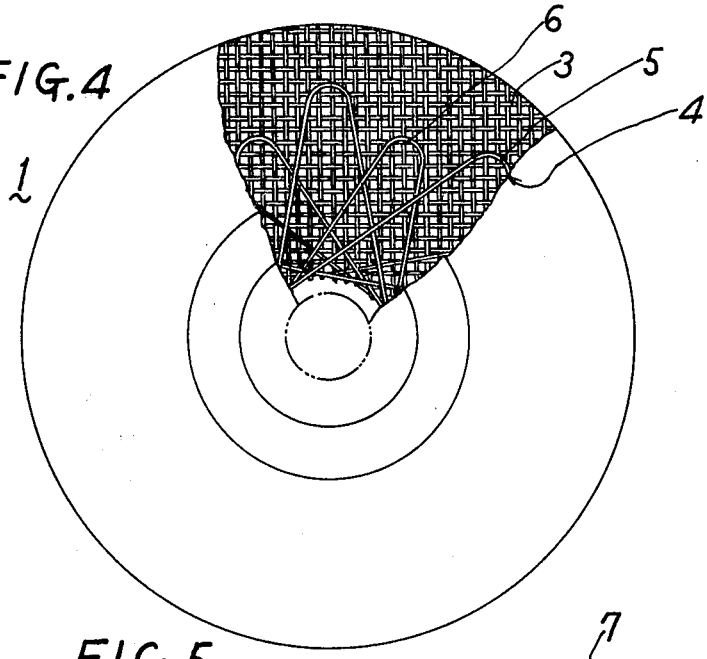
FIG. 4 is a rear view of the grinding wheel of the present invention, partly broken away, to manifest the core material of woven fabric and the core material of floral design.
Figure 5:
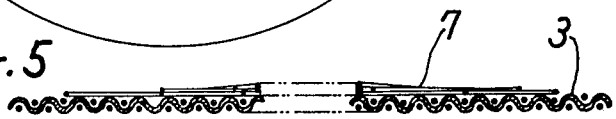
FIG. 5 is a longitudinal section, at the center, of the core material of woven fabric and the core material of floral design, placed one upon another.

In the drawings, numeral 1 denotes a grinding wheel of offset type according to the present invention, which comprises an abrasive layer 2 made by mixing grinding grains with a phenolic thermo-hardening resin binding agent; a core material 3 of woven fabric or a woven fabric of glass fiber yarn treated with a coating agent; and a core material of floral design 7, having assembly of long petals 5 and short petals 6 of glass fiber yarn 4 arranged radially and symmetrically (multi-peritrochoid shape) and treated with the same coating agent as used for the core material of woven fabric 3. The core material of floral design 7 and the core material of woven fabric 3 are also embedded in the surface layer of grinding side and in the surface layer of non-grinding side respectively. Made on the surface of the grinding side are shallow grooves 12 of chequers 8, 9 and oblique lines 10, 11 connecting intersecting points of the chequers. The grinding wheel 1 has an offset portion 13 formed at its central part and a central metal fitting 15 is embedded in the circumferential edge of a central hole 14 of the offset portion 13.

Figure 6:
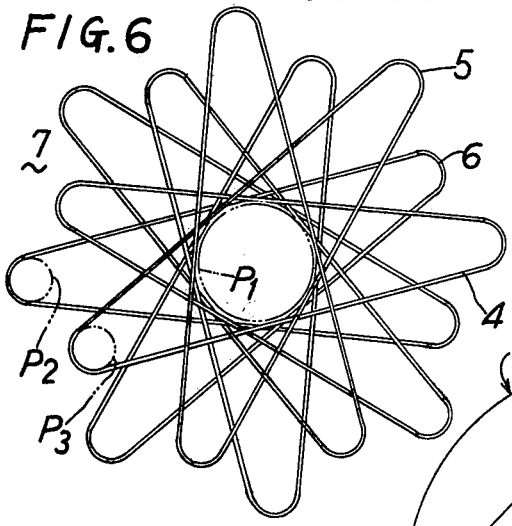
FIG. 6 is a front view of the core material of floral design.
Figure 7:
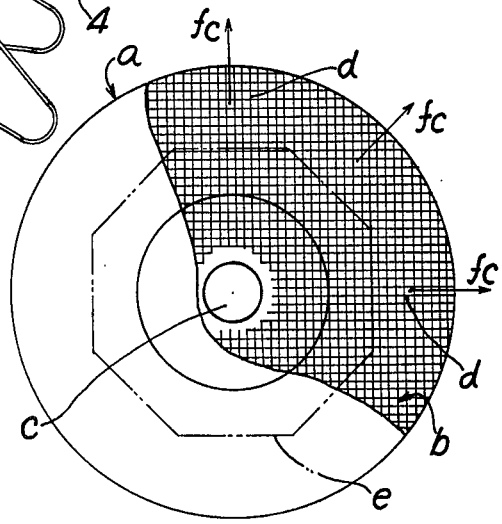
FIG. 7 is a front view of the conventional grinding wheel.

The core material of floral design is formed by winding glass fiber yarn round a central pin $P_1$ and outer circumferential pins $P_2$, $P_3$ of the required number arranged circularly as shown by FIG. 6. These pins are fixed on a forming frame (not shown in the drawings). In order to avoid cracking (crack e) of the grinding wheel as mentioned hereinbefore, it is advisable to make the diameter of a long petal of floral design around 80% of that of the grinding wheel and to make the diameter of a short petal 60% or more of that of the grinding wheel. The ratio between the long petal diameter and the short petal diameter should preferably be around 85%, but petals may consist of several types, for example, long petals, fairly long petals and short petals. The afore-mentioned core material of woven fabric 3 can be replaced by a chequered core material made by placing a group of resin-coated yarn arranged in parallel upon another group of resin-coated yarn arranged similarly in such a fashion that yarns of the two groups make a right angle with each other and by heat-bonding the intersecting points of the yarns.

Since the grinding wheel according to the present invention includes the core material of floral design which has high strength in the direction on which centrifugal force acts, as well as the conventional core material of woven fabric, it is excellent in high speed function. As the core material of floral design can be imparted with the required strength by a small quantity of glass fiber, it involves less disjoining of grinding grain layers with a core material as a boundary. The assembly of long petals and short petals for the core material of floral design brings such advantage that tips of petals are dispersed in diametrical direction and thus the grinding wheel is prevented from being cracked.

What is claimed is:

1. An offset grinding wheel for grinding on a radial face thereof comprising abrasive grains, at least one reinforcing core, said at least one reinforcing core comprising an open mesh fabric of fibreglass cord, a central opening, at least one reinforcing network, said abrasive grains and reinforcing core and reinforcing network all bonded in a resinous bonding material, and said reinforcing network comprising yarn of fibreglass, said network further comprising a symmetrical radial pattern of long segments and short segments, each said segment including an apex and arms, said arms tangent to the central opening of said grinding wheel, said arms being straight, the apices of said long segments and said short segments diametrically apposed, said long segments equal to approximately eighty percent of the radius of said grinding wheel, said short segments equal to approximately sixty percent of the radius of said grinding wheel.

2. The invention of claim 1 including a plurality of reinforcing cores.

3. The invention of claims 1 including a plurality of reinforcing networks.

4. The invention of claim 2 including a plurality of reinforcing networks.

5. The invention of claim 1 wherein said reinforcing network comprises a continuous yarn.

* * * * *